US009079071B2

(12) United States Patent
Allain et al.

(10) Patent No.: US 9,079,071 B2
(45) Date of Patent: Jul. 14, 2015

(54) EXERCISE APPARATUS AND ASSOCIATED METHODS

(76) Inventors: Stephanie Allain, Indian Harbour Beach, FL (US); Craig Allain, Indian Harbour Beach, FL (US)

( * ) Notice: Subject to any disclaimer, the term of this patent is extended or adjusted under 35 U.S.C. 154(b) by 168 days.

(21) Appl. No.: 13/458,670

(22) Filed: Apr. 27, 2012

(65) Prior Publication Data

US 2012/0277079 A1 Nov. 1, 2012

Related U.S. Application Data

(60) Provisional application No. 61/480,136, filed on Apr. 28, 2011.

(51) Int. Cl.

| | |
|---|---|
| ***A63B 26/00*** | (2006.01) |
| ***A63B 23/08*** | (2006.01) |
| ***A63B 23/10*** | (2006.01) |
| ***A63B 22/00*** | (2006.01) |
| ***A63B 69/18*** | (2006.01) |
| ***A63B 71/00*** | (2006.01) |
| ***A63B 21/00*** | (2006.01) |
| ***A63B 21/02*** | (2006.01) |
| ***A63B 21/055*** | (2006.01) |
| ***A63B 22/16*** | (2006.01) |
| ***A63B 23/035*** | (2006.01) |
| ***A63B 23/04*** | (2006.01) |

(Continued)

(52) U.S. Cl.

CPC ..... *A63B 21/1488* (2013.01); *A63B 21/00065* (2013.01); *A63B 21/023* (2013.01); *A63B 21/0428* (2013.01); *A63B 21/055* (2013.01); *A63B 22/16* (2013.01); *A63B 23/03508* (2013.01); *A63B 23/0405* (2013.01); *A63B 21/0552* (2013.01); *A63B 22/203* (2013.01); *A63B 26/00* (2013.01); *A63B 2208/0204* (2013.01); *A63B 2210/50* (2013.01)

(58) Field of Classification Search

CPC ..... A63B 22/0087; A63B 22/00; A63B 22/0015; A63B 22/20; A63B 22/201; A63B 22/203; A63B 21/02

USPC ..... 482/51, 70, 72, 92, 121–123, 129, 131, 482/140, 142, 145–147; 601/98

See application file for complete search history.

(56) References Cited

U.S. PATENT DOCUMENTS 1,980,036 A * 11/1934 Casler et al. ..... 482/72
3,130,968 A * 4/1964 De Feen ..... 482/132

(Continued)

*Primary Examiner* — Stephen Crow
*Assistant Examiner* — Garrett Atkinson
(74) *Attorney, Agent, or Firm* — Mark R. Malek; Daniel C. Pierron; Widerman Malek, PL

(57) ABSTRACT

An exercise apparatus may include a track having a first end and a second end, and a first pad fixedly attached to the first end of the track. The first pad may include a pedestal, a support structure attached to a lower surface of the pedestal and extending generally downwards therefrom, and an attachment member extending from a surface of the support structure to an outer edge of the pedestal. The exercise apparatus may also include a second pad slidably coupled to the track. The second pad may include a slidable vehicle and a top pad fixedly connected to the slidable vehicle. The exercise apparatus may further include a first bumper and a second bumper connected to the track. The first bumper may be connected to the track adjacent the first end, and the second bumper may be connected to the track adjacent the second end.

15 Claims, 6 Drawing Sheets

(51) Int. Cl.
*A63B 21/04* (2006.01)
*A63B 22/20* (2006.01)

(56) References Cited

U.S. PATENT DOCUMENTS 4,529,194 A * 7/1985 Haaheim ..... 482/70
4,679,786 A * 7/1987 Rodgers ..... 482/70
4,695,050 A * 9/1987 Smith et al. ..... 482/73
4,826,158 A * 5/1989 Fields, Jr. ..... 482/142
5,279,530 A * 1/1994 Hess ..... 482/70
5,328,427 A * 7/1994 Sleamaker ..... 482/71
5,499,961 A * 3/1996 Mattox ..... 482/132
6,071,217 A * 6/2000 Barnett ..... 482/121
6,213,924 B1 * 4/2001 Kaiyoorawongs ..... 482/146
6,280,366 B1 * 8/2001 Hsieh ..... 482/130
6,368,254 B1 * 4/2002 Wall ..... 482/71
6,440,045 B1 * 8/2002 Gaston ..... 482/140
6,527,685 B2 * 3/2003 Endelman et al. ..... 482/121
6,821,231 B1 * 11/2004 Hall ..... 482/51
6,923,748 B1 * 8/2005 Mauz et al. ..... 482/70
7,384,384 B2 * 6/2008 Horvath ..... 482/142
7,780,585 B1 * 8/2010 Rivas ..... 482/140
7,798,943 B1 * 9/2010 Tsai ..... 482/70
7,892,152 B1 * 2/2011 Teng ..... 482/79
8,500,611 B2 * 8/2013 Hoffman ..... 482/123
8,740,758 B2 * 6/2014 Sandvig ..... 482/79
2004/0023760 A1 * 2/2004 Cockrill et al. ..... 482/93
2004/0142800 A1 * 7/2004 Gerschefske ..... 482/142
2004/0176227 A1 * 9/2004 Endelman ..... 482/142
2005/0245372 A1 11/2005 Mylrea et al.
2012/0115694 A1 * 5/2012 Chen ..... 482/142

* cited by examiner

EXERCISE APPARATUS AND ASSOCIATED METHODS

RELATED APPLICATIONS

This application claims the benefit of U.S. Provisional Application Ser. No. 61/480,136 entitled Exercise Machine filed Apr. 28, 2011, the entire contents of which are incorporated herein by reference.

FIELD OF THE INVENTION

The present invention relates to the field of exercise machines and, more specifically, to exercise machines to facilitate the performance of a variety of physical exercise routines.

BACKGROUND OF THE INVENTION

Since before the establishment of the U.S. Patent and Trademark Office, physical activity has been an essential component of a healthy life. Many people perform a variety of exercise routines to satisfy their needs physical activity. Some exercise routines have been adapted to target the strengthening and toning of specific muscle groups. More specifically, exercises routines may exist to target the strengthening and toning of gluten, hamstrings, knees, and other various muscle groups.

General exercises may be performed without the aid of specialized equipment, However, without utilizing specialized equipment, a user may not be able to isolate specific muscle groups that the user desires to strengthen or tone. Additionally, without utilizing specialized equipment, a user may not be able to maximize the effectiveness of his or her exercise routine, since the user will not be able to easily add resistance to the exercise.

The invention disclosed in U.S. Patent Application Publication 2005/0245372, submitted by Mylrea, et al., has sought to solve these problems by providing a sliding element that may be repositioned in any direction on an exercise floor. The sliding element may allow performance of many exercises with reduced friction under the limb on the sliding element. However, an exercising party may desire to increase the friction applied to the limb being exercised to maximize the efficiency of the exercise routine being performed. Furthermore, the apparatus disclosed in the Mylera '372 publication may provide little control in the direction which a limb may slide. This lack of control may lead to improper form, minimizing the effectiveness of the exercise.

There exists a need for an exercise machine that may facilitate the performance of various exercise routines. Additionally, there exists a need for an exercise machine that may provide an increased resistance to the muscle group being strengthened or toned, resulting in increased efficiency when performing an exercise routine.

SUMMARY OF THE INVENTION

With the foregoing in mind, the present invention advantageously provides an exercise machine that may facilitate the performance of various exercise routines. Additionally, the exercise machine of the present invention may provide increased resistance to the muscle group targeted to be strengthened or toned, advantageously enhancing the efficiency of the exercise routine being performed.

The exercise apparatus, according to an embodiment of the present invention, may include a track having a first end and a second end, and a first pad fixedly attached to the first end of the track. The first pad may have a pedestal, a support structure attached to a lower surface of the pedestal and extending generally downwards there from and an attachment member extending from a surface of the support structure to an outer edge of the pedestal, The exercise apparatus may further include a second pad slidably coupled to the track. The second pad may have a slidable vehicle, and a top pad fixedly connected to the slidable vehicle. Furthermore, the exercise device may include a first bumper and a second bumper connected to the track. The first bumper may be connected to the track adjacent the first end, and the second bumper may be connected to the track adjacent the second end.

A method aspect of the present invention is for using an exercise apparatus. The method may include applying a first force to either, or both, of the first pad and the second pad, causing the second pad to slide along the track in a direction away from the first pad. The method may also include applying a second force to either or both of the first pad and the second pad causing the second pad to slide along the track in a direction towards the first pad.

DETAILED DESCRIPTION OF THE PREFERRED EMBODIMENT

The present invention will now be described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout. Prime and multiple prime notations, when used, indicate like elements in alternate embodiments.

In this detailed description of the present invention, a person skilled in the art should note that directional terms, such as "above," "below," "upper," and other like terms, are used for the convenience of the reader in reference to the drawings. Also, a person skilled in the art should notice this description may contain other terminology to convey position, orientation, and direction without departing from the principles of the present invention.

Embodiments of the present invention are described herein using the context of an exercise machine 10 that may facilitate the performance of "lunges" and related exercises. Skilled artisans will appreciate additional exercise routines that may be performed on the exercise machine 10 of the present invention after having the benefit of this disclosure. Those of ordinary skill in the art will further appreciate that the following embodiments of the present invention are only illustrative and are not intended to be limiting in any way. Other embodiments of the present invention will readily suggest themselves to such skilled persons after having the benefit of this disclosure.

Referring now to FIGS. 1-9, an exercise machine 10 according to the present invention is now described in greater detail. Throughout this disclosure, the exercise machine 10 may also be referred to as a machine, "lunge" machine, exercise equipment, or equipment. Alternate references of the exercise machine 10 in this disclosure are not meant to be limiting in any way.

Figure 1:
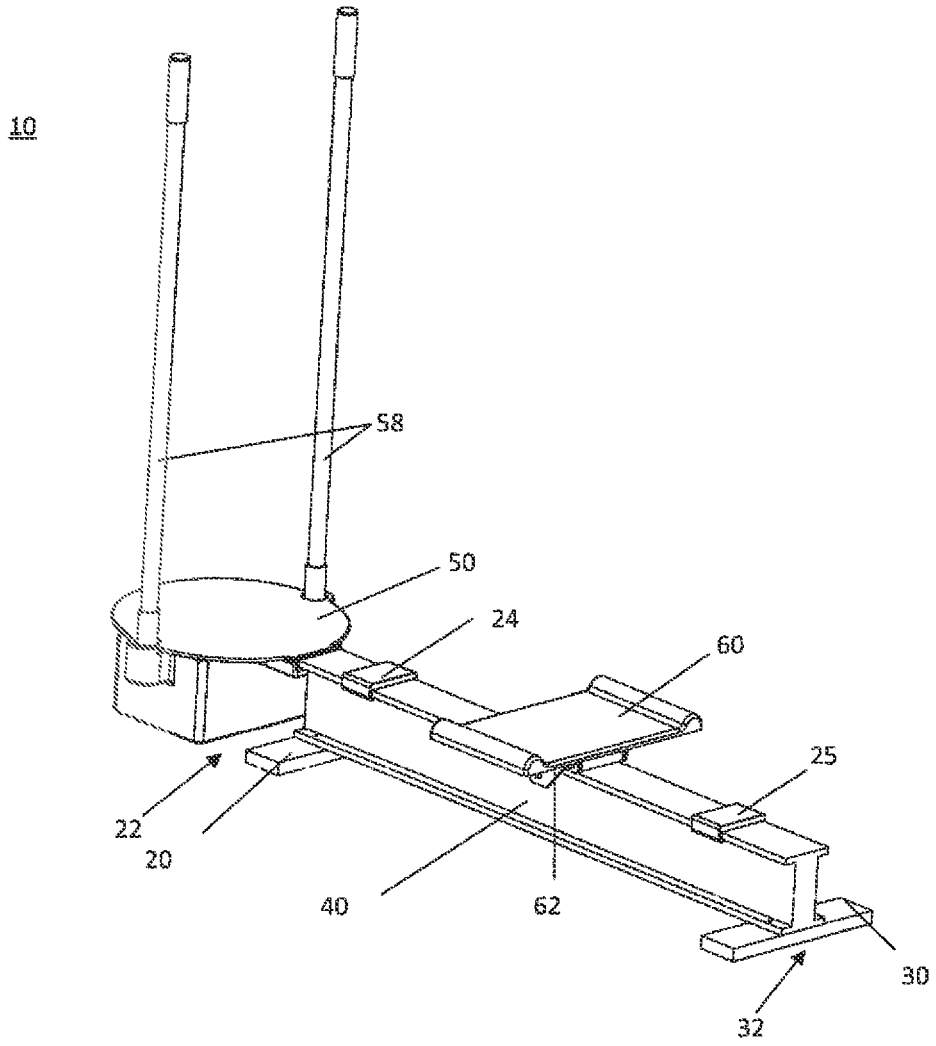
FIG. 1 is a perspective view of an exercise apparatus according to an embodiment of the present invention.

As illustrated in FIG. 1, the exercise machine 10 according to an embodiment of the present invention may include a first end 22 and a second end 32 connected by a track 40. The first end 22 may include a first end base 20 and a stationary pad 50. The second end 32 may include a second end base 30. A slidable pad 60 may be positioned on the track 40, which may be variably repositioned between first end 22 and the second end 32 of the exercise machine 10. The exercise machine 10 may further include one or more bumpers. Each bumper may be releasably attached to the track 40. A first bumper 24 may be positioned adjacent the first end 22, and a second bumper 25 may be positioned adjacent the second end 32.

The first end 22 and the second end 32 may provide contact points with a support surface. The support surface may be a floor or ground surface. However, a person of skill in the art will appreciate that a support surface may include any surface capable of supporting an object, such as the exercise machine 10 of the present invention, and remain within the scope and spirit of the present invention.

The first end 22 of the exercise machine 10 according to the present invention may include a first end base 20 and a stationary pad 50. The first end base 20 may be adjacently located to the track 40 and stationary pad 50. In an embodiment of exercise machine 10 according to the present invention, the first end base 20 may be operatively connected to the track 40, which may be further operatively connected to the stationary pad 50, wherein the operative connections may support the stationary pad 50 and a user during operation of the exercise machine 10 of the present invention. In this embodiment, the first end base 20 may be connected to the track 40 by bolts, studs, adhesives, welded joints, or other types of connections understood by a skilled artisan that may sufficiently support the weight of the exercise machine 10 and a potential user. The stationary pad 50 may be connected at the first end 22 of the exercise machine 10 in a stationary configuration. This stationary configuration may not allow the stationary pad 50 to be repositioned during operation of the exercise machine 10. In an alternate embodiment, the stationary pad 50 may be operatively connected to the track 40 and/or first end base 20 of the exercise machine 10 such that it may pivot about one or more axes during operation. By allowing the stationary pad 50 to be pivotally repositioned, the exercise machine 10 of the present invention may advantageously provide additional comfort to a user during its operation. A person of skill in the art will appreciate additional embodiments in which the stationary pad 50 may be operatively connected to additional components of the exercise machine 10 at the first end 22, which exist within the scope and spirit of the present invention.

Figure 2:
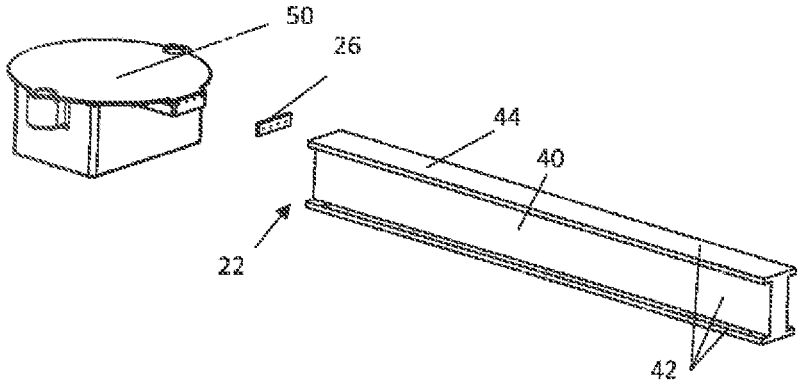
FIG. 2 is a partial exploded perspective view of portions of the exercise apparatus illustrated in FIG. 1.
Figure 3:
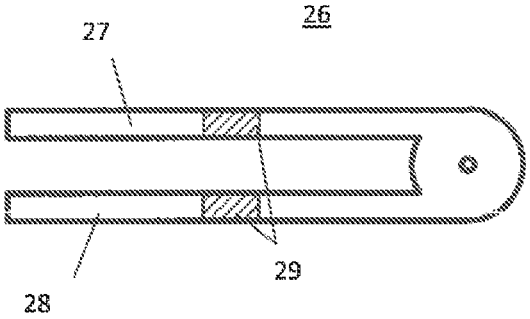
FIG. 3 is profile view of a hinge of the exercise apparatus illustrated in FIG. 1.

Referring to FIG. 2, as an example, and without limitation, the stationary pad 50 may be operatively connected to the first end 22 by a hinge 26. Referring now to FIG. 3, the hinge 26 may include a first plate 27 that may be fixedly attached to the stationary pad 50 as depicted in FIG, 2 and a second 28 plate that may be fixedly attached to the track 40 as depicted in FIG. 2. The first plate 27 and the second plate 28 may be fixedly attached by bolts, studs, adhesives, welded joints, or other types of connections understood by a skilled artisan that may sufficiently support the weight of the stationary pad 50, the track 40, or both. Each of the first plate 27 and the second plate 28 may include one or more apertures 29 to facilitate attachment, for example, permitting a fastener to pass therethrough. The first plate 27 is rotatably coupled to the second plate 28. The rotation of the first plate 27 with respect to the second plate 28 permits the stationary pad 50 to be repositioned with respect to the track 40, for example, the stationary pad 50 may be positioned generally above or on top of the track 40, Now referring to FIGS. 1-2, the stationary pad 50 may be constructed of any material sufficient to support the weight of a user during operation of the exercise machine. As will be appreciated by a person of skill in the art, such material may include, but should not be limited to, steel, aluminum, hardened plastics, composites, carbon fiber, or other sufficient supportive materials.

The stationary pad 50 may be configured as any shape and/or size that may be sufficient to support and accommodate a desired part of an exercising user that may be positioned on the stationary pad 50 during an exercise routine. As a non-limiting example, a circular shaped stationary pad 50 measuring approximately one foot in diameter may be sufficient to support the foot of a user performing lunge exercises. As another non-limiting example, an ovoid shaped stationary pad 50 measuring approximately two feet at its longest diameter may be necessary to accommodate the foot, knee, buttocks, or any other part of the anatomy of an exercising user performing exercises.

The first end 22 and second end 32 of the exercise machine 10 of the present invention may be connected by a track 40. The track 40 may be comprised of one or more track members 42 that may connect the first and second ends 22, 32 of the exercise machine 10. Alternatively, the track 40 may be formed of a single, integral body. Track members 42 may be configured to extend from the first end 22 to the second end 32 of the exercise machine 10 in a straight line. A straight line configuration is defined as the track 40 being substantially parallel to the support surface. However, a person of skill in the art will appreciate embodiments of the present invention that may include a track 40 configured with a curved, concave, convex, catawampus, circuitous, or countless other configurations that are not linearly straight. Additionally, the track 40 may be positioned such that an incline or decline may exist as the track 40 may extend from the first end 22 to the second end 32. Such inclines or declines may be provided by an elevated second end 32 or first end 22, respectively. As will be understood by a skilled artisan, the elevated configurations may be adjustable.

The track 40 of the present invention may be formed into any shape that enables the slidable pad 60 to attach thereto. Shapes of the track 40 include an I-configuration, a rectangle, a square, or any other polygon. Furthermore, now referring to FIG. 9, the track 40 may include a plurality of apertures 900 at the end of the track 40 adjacent the first end 22, the second end 32, or both. The apertures 900 may cooperate with the apertures 29 of the hinge 26, facilitating attachment thereto as described hereinabove.

Referring now back to FIG. 1, the track 40 may connect to a second end base 30 at the second end 32 of the exercise machine 10, Similar to the connective structure of the first end base 20 and the track 40, the second end base 30 may be adjacent to the track 40. The second end base 30 may be connected to the track 40 by bolts, studs, adhesives, welded joints, or other types of connections understood by a skilled artisan that may be sufficient to support the weight of the exercise machine 10 and a potential user.

A person of skill in the art will appreciate that additional bases may be located between the first base 20 and the second base 30 within the scope of the present invention. Such additional bases may advantageously help distribute the weight applied to the components of the exercise machine 10 during its operation.

Figure 4:
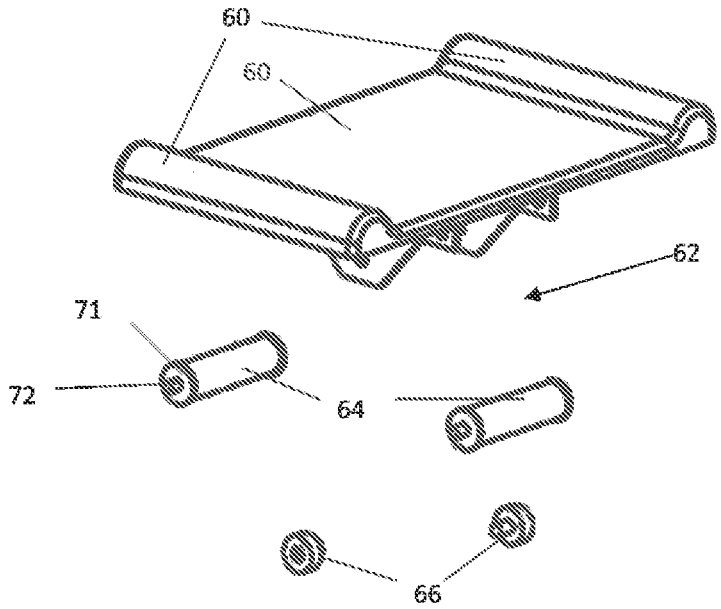
FIG. 4 is an exploded perspective view of a slidable vehicle of the exercise apparatus illustrated in FIG. 1.

As illustrated in FIG. 1, a slidable vehicle 62 may be located on the track 40 of the exercise machine 10 of the present invention. Referring now to FIG. 4, the slidable vehicle 62 may include a slidable pad 60, one or more wheels 64, and one or more stabilizing members 66. The slidable pad 60 of the exercise machine 10 of the present invention may attach to a slidable vehicle 62, advantageously allowing lateral repositioning of the slidable pad 60 during operation. In other words, the slidable pad 60 is laterally moveable towards and away from the stationary pad 50. The slidable vehicle 62 may include structural surfaces to enclose at least a portion of the track 40 of the exercise machine 10. A person of skill in the art will appreciate the slidable vehicle 62 may partly or completely enclose the track 40.

Figure 5:
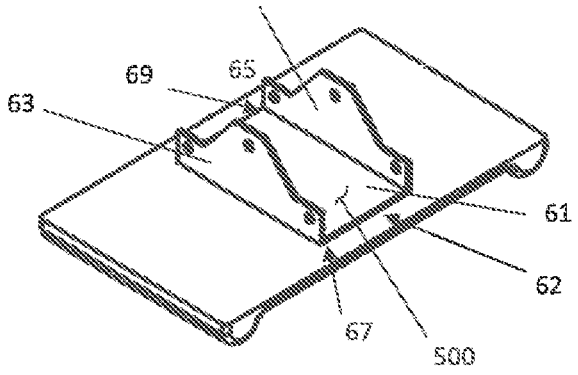
FIG. 5 is a bottom perspective view of le slidable vehicle of the exercise apparatus illustrated in FIG. 1.

For clarity, a non-limiting example of a slidable pad 60 will now be discussed. A skilled artisan will appreciate the following example is provided for clarity purposes, and should not be viewed as a limitation to the present invention. As illustrated in FIG. 5, the slidable vehicle 62 of the exercise machine 10 according to an embodiment of the present invention may include a first side vehicle member 63 and a second side vehicle member 65 positioned approximately parallel to each other. The first and second side vehicle members 63, 65 may connect to a top vehicle member 61 of the slidable vehicle 62, the connection being discussed in greater detail below. The first and second side vehicle members 63, 65 may also include a top end and a bottom end, as the first and second vehicle side members 63, 65 are oriented in the vertical position and substantially perpendicular to the track (not shown).

The first and second side vehicle members 63, 65 may be configured to enclose a portion of the track. The first and second side vehicle members 63, 65 may also enclose the components of the slidable vehicle 62 that may contact the track, such as the wheels 64 that are discussed below. By enclosing the components of the slidable vehicle 62 that may contact the track, the first and second side vehicle members 63, 65 may advantageously reduce the likelihood of injury during operation of the exercise machine 10 of the present invention.

The top vehicle member 61 may include a first top vehicle member end 67 and a second top vehicle member end 69. The top vehicle member 61 may also include a top surface (not shown) and a bottom surface 500. The top end of the first side vehicle member 63 may be attached to and extend downwardly from the bottom surface 500 of the top vehicle member 61 at approximately the first top vehicle member end 67. Likewise, the top end of the second side vehicle member 65 may be attached to and extend downwardly from the bottom surface 500 of the top vehicle member 61 at approximately the second top vehicle member end 69. The first and second side vehicle members 63, 65 may be orthogonally connected to the top vehicle member 61 at the respective ends 67, 69 by bolts, studs, adhesives, welded joints, or other types of connections understood by a skilled artisan.

Referring now to FIGS. 1 and 4-5, the interconnection of the top vehicle member 61 with the slidable vehicle side members 63, 65 may comprise the structural frame of the slidable. vehicle 62. From top to bottom, the slidable pad 60 may be parallel with the top vehicle member 61, wheels 64, a top surface 44 of the track 40, and stabilizing member 66. The first and second side vehicle members 63, 65 may extend downwardly in an orthogonal configuration from the top vehicle member 61 to at least partially enclose the wheels 64, track 40, and stabilizing member 66. The top end of the first and second side vehicle members 63, 65 may be adjacent to the slidable pad 60. Additionally, the bottom end of the first and second side vehicle members 63, 65 may extend below the orthogonally located stabilizing member 66. The slidable vehicle 62 may further include wheels 64, which may be located adjacent to the track 40. More specifically, the wheels 64 may include a rotatable surface that may contact the surface of the track 40. Furthermore, the wheels 64 may be rotatably coupled to the first and second vehicle members 63, 65 by one or more bearings 71 including a post 72 extending generally away from the wheels 64. The post 72 may be attached to one of the first and second vehicle members 63, 65 by any method sufficient to support the forces applied by and to the slidable pad 60, such as by weld, bolt and nut, adhesive, and any other types of connections understood by a skilled artisan.

The inclusion of the stabilizing member 66 may ensure that the slidable vehicle 66, and thus also the slidable pad 60, may remain properly oriented on the track 40 during operation of the exercise machine 10 of the present invention. As a result, a contacting body part of a user, i.e. foot, may advantageously be kept in proper alignment during operation of the exercise machine 10. The proper body alignment may further provide the benefit of assisting a user to maintain proper form as she may perform exercise routines, such as lunges, on the exercise machine 10 of the present invention. Additionally, since the exercise machine 10 may increase the likelihood of maintaining proper form, it may advantageously decrease the likelihood of physical injuries that may occur due to performing an exercise routine with improper form.

In an alternative embodiment, the top vehicle member 61 may additionally include wheel mounts. The wheel mounts may be connected to the top vehicle member 61 by bolts, studs, adhesives, welded joints, axle joints, bearings, looping enclosures, or additional connective structures that may allow the rotation of the wheels 64 as the slidable vehicle 62 may be repositioned along the track 40.

The wheels 64 may be supported by the wheel mounts. As previously discussed, the wheels 64 may also contact the track 40. The wheel mounts may be orthogonally positioned with respect to the orientation of the top vehicle member 61. Additionally, the wheels 64 may be orthogonally located with respect to the wheel mounts.

The wheels 64 may be positioned approximately parallel to the top vehicle member 61 and the track 40. A person of skill in the art will appreciate that the wheels may be made of any material that may support the weight of the slidable vehicle 62 and a user during operation of the exercise machine 10 of the present invention. Provided as a non-limiting example, such materials may include metals, plastics, fiberglass, carbon fiber, wood, rubber, alloy compounds, or other materials sufficiently durable to support the weight that may be applied to the wheels 64 during operation of the exercise machine 10 of the present invention.

Through the interconnection of the top vehicle member 61 to the wheels 64 as well as the track 40 and the slidable vehicle 62, the slidable vehicle 62 may be repositionably supported by the track 40. For added stability, a stabilizing member 66 may be included to reduce the possibility of derailment during operation of the exercise machine 10 of the present invention. The stabilizing member 66 may be orthogonally connected to the first and second side vehicle members 63, 65 below an upper surface of the track 40. As a result, the stabilizing member 66 may be positioned such that it is substantially parallel with the wheels 64 and the top vehicle member 67 of the slidable. vehicle 62. However, a skilled artisan will appreciate that the stabilizing member 66 may be located at any position or orientation within the scope of the present invention such that the stability of the slidable vehicle 62 may be enhanced.

A slidable pad 60 may be attached to the top vehicle member 61 of the slidable vehicle 62. The slidable pad 60 may be configured as any shape and/or size that may be sufficient to support and accommodate a desired part of an exercising user that may be positioned on the slidable pad 60 during an exercise routine. As a non-limiting example, a circular shaped slidable pad 60 measuring approximately one foot in diameter may be sufficient to support the foot of a user performing "lunge" exercises. As another non-limiting example, an ovoid shaped slidable pad 60 measuring approximately two feet at its longest diameter may be necessary to accommodate the foot, knee, buttocks, or any other part of the anatomy of an exercising user performing abdominal exercises.

A person of skill in the art will appreciate that the preceding example has been provided for illustrative purposes only, and should not be read as limiting the embodiment discussed above. Alternate connective or supportive structures to allow a slidable vehicle 62 to be repositioned about a track 40 would be obvious to a skilled artisan, and should be considered within the scope and spirit of the present invention.

Figure 6:
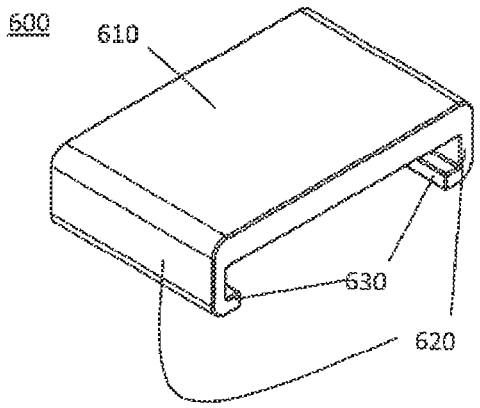
FIG. 6 is a perspective view of a bum per of the exercise apparatus illustrated in FIG. 1.
Figure 7:
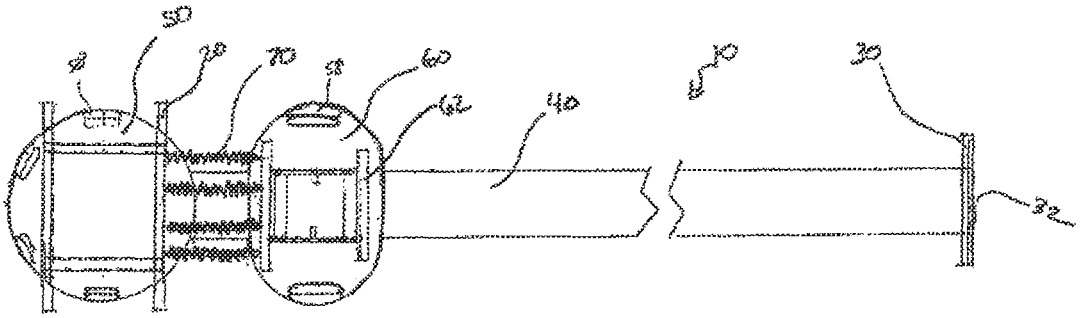
FIG. 7 is a top plan view of an exercise apparatus according to an embodiment of the present invention.

The bumpers 24, 25 may have configuration similar or identical to that of the bumper 600 in FIG. 6. The bumper 600 may be configured to releasably attach to the track (not shown). In the present embodiment, the bumper 600 is configured to releasably attach to a track having an I-shaped configuration. The bumper 600 may include a top section 610, side sections 620, and bottom sections 630. The top section 610 may be configured to have a width greater than a width of a top section of the track 40. Furthermore, the top section 610 may connect with the side sections 620, wherein the side sections 620 are configured to be disposed adjacent to the sides of the track. Yet further, the side sections 620 may be connected to the bottom sections 630, wherein the bottom sections 630 are configured to be disposed beneath a top surface of the track.

The top section 610 and the bottom sections 630 may define a gap therebetween, wherein the gap is slightly greater than a thickness of a top portion of the track, wherein the top portion of the track defines the aforementioned top surface. In this configuration, the bumper 600 may be attached to the top portion of the track 40 by, for instance and without limitation, sliding the bumper 600 onto the top portion of the track at the second end (not shown). In another example, and without limitation, the bumper 600 may be formed of a flexible material allowing for elastic deformation of at least a portion of the bumper, including the top section 610, the side sections 620, and the bottom sections 630. In this embodiment, any of the top section 610, side sections 620, and bottom sections 630 may be deformed to permit the bottom sections 630 to be disposed beneath the top section of the track.

Referring now back to FIG. 1, the bumpers 24, 25 may attach to the track 40 in order to define an operational region of the track 40 therebetween, within which the slidable pad 60 is bounded. In order to prevent the slidable pad 60 from moving either of the bumpers 24, 25 and hence out of the operational region of the track 40 the bumpers 24, 25 may be configured to attach to the track in order to provide sufficient resistance to withstand a force applied by and through the slidable. pad 60, for example, a user pushing this slidable. pad 60 into either of the bumpers 24, 25.

The releasable attachment of the bumpers 24, 25 to the track 40 permits the repositioning of the bumpers 24, 25 to change the operational region of the track 40. In doing so, the operational region of the track 40 may be configured to provide a desirable distance for the slidable pad 60 to move along the track 40, Referring now back to FIG, 7, according to an alternative embodiment of the exercise machine 10, a resistive member 70 of the exercise machine 10 will now be discussed. The resistive member 70 may be connected between the slidable vehicle 62 and a base of the exercise machine 10 of the present invention. For clarity, the forgoing non-limiting example will discuss the resistive member 70 as being connected between the stationary pad 50 and the slidable vehicle 62. However, a person of skill in the art will appreciate additional connective locations that will provide resistance during operation of the exercise machine 10 of the present invention.

The resistive member 70 may be comprised of any resistive structure that may oppose the free movement of the slidable vehicle 62. Such resistive member 70 structures may include springs, elastic bands, rubberized materials, resistive bands, pulleys and weights, eddy currents, or other resistive configurations that would be known to a person of skill in the art. Furthermore, as will be appreciated by a skilled artisan, the resistance provided by the resistive member 70 may be linear, constantly variable, exponentially variable, or altering by any other degree of variability within the scope of the present invention.

The use of springs may provide the exercise machine 10 with varying resistance. As indicated above, this can also be accomplished using elastic bands. The exercise machine 10 according to an embodiment of the present invention also contemplates the use of multiple elastic bands to provide resistance when moving the slidable pad 60 away from the stationary pad 50. For example multiple elastic bands may be positioned on either side of the slidable pad 60 and connected adjacent to the stationary pad 50 so that degrees of resistance may be changed depending upon the strength, skill and coordination of the user. In other words, and only meant as a non-limiting example, a stronger user may connect three elastic bands on either end of the slidable pad 60 adjacent to the stationary pad 50, while another user may only desire the resistance associated with two bands per side. Accordingly, the exercise machine 10 according to an embodiment of the present invention advantageously allows users to customize the amount of resistance that may be desired in order to carry out a sufficient workout.

The exercise machine 10 of the present invention may facilitate the performance of a variety of exercise routines. Additionally, the exercise machine 10 of the present invention may provide additional resistance while performing exercises, advantageously increasing the effectiveness of the exercise.

An example of the exercise machine 10 of the present invention in operation will now be discussed. For clarity, the following example will discuss the use of the exercise machine 10 of the present invention as it is used to perform "lunges," an exercise routine that involves extending one leg in the forward direction while keeping the other leg stationary and bringing the knee of the stationary leg towards the ground. A person of skill in the art will appreciate numerous additional exercises that may be performed on the exercise machine 10 of the present invention in addition to the example of "lunges" below.

Using the exercise machine 10 of the present invention to perform a "lunge" exercise, a user may be positioned with a front foot on the stationary pad 50 a rear foot on the slidable pad 60. The user may be initially positioned with each foot shoulder length apart. The user may then shift his body weight backward, until the knee of the leg positioned on the slidable pad 60 is bent to approximately ninety degrees. The user may then return to the initial position.

As the user shifts his/her body weight backward, the slidable pad 60 may be repositioned forward along the track 40 via the slidable vehicle 62 so that the slidable vehicle 62 moves away from the stationary pad 50. More specifically, the wheels 64 of the slidable vehicle 62 may allow the slidable vehicle and the slidable pad 60 to be readily repositioned forward in a controlled path. As the user may return to the initial position of the exercise routine, the slidable pad 60 may also return to its initial position.

In embodiments of the exercise machine 10 according to the present invention that include a resistive member 70, as the user shifts his/her body weight backward, the slidable pad 60 may encounter resistance provided by the resistive member 70 as it may also be repositioned forward. In the following example the resistive member 70 is assumed to be a spring. As the user may shift his body weight forward, the slidable pad 60 may also move forward, pulling on the spring attached to the first end base 20 and the slidable vehicle 62. The spring may then create a resistance to the movement as it is expanded. As the user returns to the initial position, the spring may release energy as compressed, requiring the user to apply a counteractive force to compensate for force applied by the spring.

Using the exercise machine of the present invention to perform an "abduction" exercise, a user may be positioned with a first foot on the stationary pad 50 and with a second foot on the slidable pad 60. The user may be initially positioned with each foot shoulder length apart. The user may then shift his weight toward the second foot, causing the slidable pad 60 to reposition along the track 40 via the slidable vehicle 62 away from the stationary pad 50. The user may then shift his weight toward the first foot, causing the slidable pad 60 to move back along the track 40 toward the stationary pad 50, returning the slidable pad 60 to its initial position.

Furthermore, a user may operate the exercise machine 10 in any way towards a specific goal, such as, for example only and without limitation, strengthening the knee joint, sport-specific exercises, or ACL rehabilitation.

Referring now to FIG. 1, in an embodiment of the exercise machine 10 according to the present invention, elongate members 58 may be included on the stationary pad 50 and/or the slidable pad 60. The inclusion of elongate members 58 that may function as handles may allow the performance of additional exercise routines that may require gripping or otherwise using the elongate members 58. The elongate members 58 may also beneficially enhance the ease of transporting the exercise machine 10 by allowing a user to more easily grip and carry the exercise machine 10. Further, the elongate members 58 may have an elongate shape so as to accommodate a grip of most users. The attachment of the elongate members 58 will be discussed in detail hereinbelow.

The track 40 of the exercise machine 10 according to an embodiment of the present invention may be comprised of multiple telescopic components. The inclusion of telescopic track 40 components may allow the length of the exercise machine 10 to be condensed. Configurations of the exercise machine 10 of the present invention with a condensed length may advantageously facilitate the transportation and/or storage of the exercise machine 10.

Figure 10:
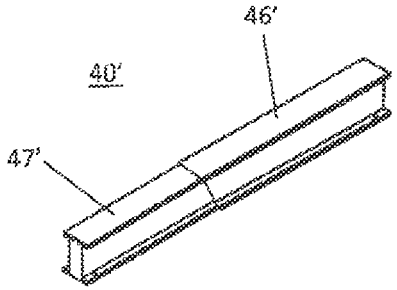
FIG. 10 is a perspective view of a track of another embodiment of the exercise apparatus.

For clarity, and with reference to FIG. 10, the foregoing example will assume a track 40' with multiple telescopic components includes only two components. However, a person of skill in the art will appreciate that multiple additional telescopic components may be included to comprise the track 40' within the scope and spirit of the present invention. The telescopic track components may include a large track component 46', which may be defined by an outer large track diameter and an inner large track diameter. The telescopic track components may also include a small track component 47', which may be defined by an outer small track diameter and an inner small track diameter.

To achieve telescopic functionality, the outer small track diameter may be smaller than the inner large track diameter. By having the diameters configured as stated above, the small track component 47' may be inserted into the large track component 46'. The small track component 47' may be slid into and out of the large track component 46' to various depths, allowing the total length of the track 40' to be adjusted. For example, as a small track component 47' is inserted deeper into the large track component 46', the length of the track 40' may be decreased. A person of skill in the art will appreciate that additional track components may be included within the scope of the present invention, and may follow the same principles as two track example provided above. A locking mechanism may be included to prevent the further sliding of the track components once a desired depth has been reached.

Referring now to FIG. 4, one or more ridges 68 may be included on the slidable pad 60 and/or the stationary pad 50 of the exercise machine 10 according to an embodiment of the present invention to prevent dislodging or supping of a body part that may be placed thereon. As a non-limiting example, the ridge 68 may prevent the unnecessary sliding of a foot placed on the pad during the practice of a "lunge" exercise routine. The ridge 68 may be connected to the top surface of either of the stationary pad 50 or the slidable pad 60, or both, and may extend upwardly therefrom. The ridge 68 may have a rectangular shape or a rounded shape, but those skilled in the art will appreciate that the ridge may have any shape suitable for providing a contact surface to prevent, or substantially decrease the possibility of the user dislodging or slipping a foot placed on the respective pad.

Figure 8:
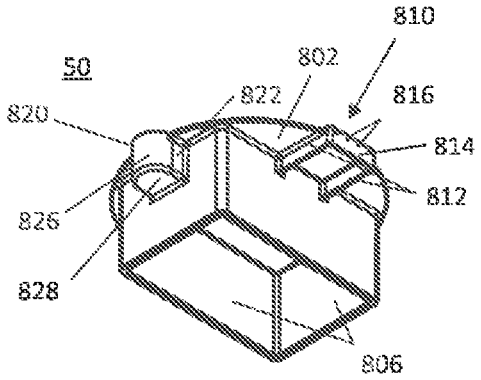
FIG. 8 is a perspective view of a pedestal of a stationary pad of the exercise apparatus illustrated in FIG. 1.
Figure 9:
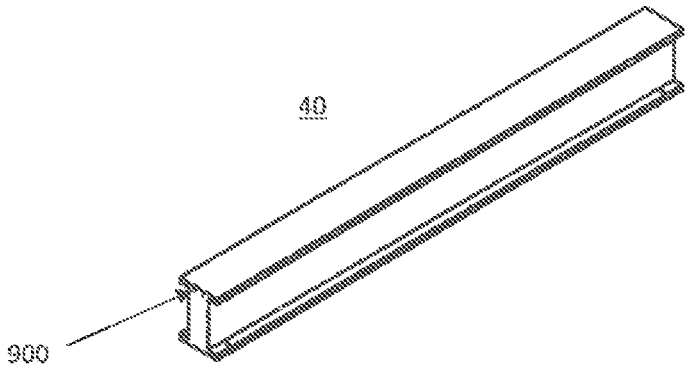
FIG. 9 is a perspective view of a track of the exercise apparatus illustrated in FIG. 1.

In one embodiment, the exercise machine 10 may include a stationary pad 50 as illustrated in FIG. 8. The stationary pad 50 may include a pedestal 802 having a substantially flat upper surface, a plurality of sidewalls 806 attached to and extending away from the pedestal 802, and an attachment member 810 attached to at least one of the sidewalls 806 and/or the pedestal 802. Furthermore, the stationary pad 50 may further include one or more receiving members 820 attached to at least one of the sidewalls 806 and/or the pedestal 802, or may be integrally formed with at least one of the sidewalls 806, the pedestal 802, or both.

The attachment member 810 may include one or more laterally extending sections 812 attached to at least one of the sidewalls 806 or the pedestal 802, or both. The attachment member 810 may further include a vertically extending section 814 attached to the pedestal, the vertically extending 814 section having a thickness and may have a plurality of apertures 816 formed through the thickness. The apertures 816 may be configured to cooperate with the apertures 29 of the hinge 26, permitting attachment thereto as described hereinabove.

Continuing to refer to FIG. 8, the receiving member 820 may be attached to at least one of the sidewalls 806, the pedestal 802, or both. Furthermore, the receiving member 820 may be integrally formed with at least one of the sidewalls 806, the pedestal 802, or both. The receiving member 820 may include first and second attachment sections 822, 824 that are connected by an arcuate section 826 defining a receiving void therebetween. The void may have sufficient dimensions to permit an end of an elongate member 58 to be disposed therewithin, as illustrated in FIG. 1. The receiving member 820 may optionally include a lower section 828 that may be attached to at least one of the sidewalls 806, a lower edge of the first and second attachment sections 822, 824, or a lower edge of the arcuate section 826, or any combination thereof. The lower section 828 may be attached by bolts, studs, adhesives, welded joints, or other types of connections understood by a skilled artisan that may sufficiently support the weight of an elongate member 58 and any force applied thereto.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. An exercise apparatus comprising:

a stationary pad comprising a pedestal, a support structure attached to a lower surface of the pedestal and extending downwardly therefrom, an attachment member connected to an end portion of the pedestal, at least one receiving member attached to at least one of the sidewalls;

a single track having a first end and a second end, the first end being connected to and extending outwardly from the stationary pad at the attachment member, the single track having an "I" shape defined by a top surface, a track member extending downwardly from the top surface, and a bottom surface connected to the track member and positioned opposite the top surface;

a slidable vehicle slidably coupled to the single track;

a slidable pad fixedly connected to the slidable vehicle;

a first bumper releasably attached to the single track adjacent the first end thereof; and a second bumper releasably attached to the single track adjacent the second end thereof;

each of the first and second bumpers including a top section, side sections and a bottom section configured so as to provide a gap between the top section and the bottom section, the gap being sized to receive the top surface of the single track when each of the first and second bumpers are slidably connected to the single track;

wherein the stationary pad is adapted to support at least a portion of an exercising user performing exercises;

wherein each of the first and second bumpers are slidably connected to the single track to define an operational region of the single track whereby the slidable pad is moveable along the single track between the first and second bumpers.

2. An apparatus according to claim 1 further comprising a first track base attached to the first end of the single track; and a second track base attached to the second end of the single track.

3. An apparatus according to claim 2 further comprising a resistive member having a first end and a second end; wherein the first end of the resistive member is attached to the first track base; and wherein the second end of the resistive member is attached to the slidable vehicle.

4. An apparatus according to claim 1 wherein the slidable vehicle comprises:

a first side vehicle member;

a second side vehicle member; and a wheel rotatably coupled to both the first vehicle member and the second vehicle member;

wherein the first and second side vehicle members are substantially parallel to each other and are set apart a distance greater than a width of the single track.

5. An apparatus according to claim 4 wherein the wheel is positioned to interface with a top surface of the single track.

6. An apparatus according to claim 4 further comprising a stabilizing member rotatably coupled to at least one of the first vehicle member and second vehicle member.

7. An apparatus according to claim 6 wherein the stabilizing member is configured to interface with a downward-facing surface of the single track.

8. An apparatus according to claim 1 wherein the slidable pad comprises a first end and a second end; and wherein at least one of the first end and the second end comprises a ridge.

9. An apparatus according to claim 1 further comprising an elongate member attached to the stationary pad, the elongate member configured to extend generally upwards from the stationary pad; wherein the elongate member is adapted to be removeably engage the at least one receiving member.

10. An apparatus according to claim 1 wherein the attachment member comprises a laterally extending section attached to the support structure and a vertically extending section attached to the pedestal, the vertically extending section having a thickness and comprising a plurality of apertures formed therethrough; and wherein the single track comprises a plurality of apertures, each of the apertures of the vertically extending section being associated with one of the apertures of the single track.

11. An apparatus according to claim 1 wherein the single track comprises a large track component and a small track component; wherein the small track component is configured to be at least partially inserted within the large track component.

12. An apparatus according to claim 1 further comprising a hinge; wherein the hinge comprises a first plate rotatably coupled to a second plate; wherein the first plate is fixedly attached to the stationary pad; and wherein the second plate is fixedly attached to the single track.

13. An exercise apparatus comprising:

a stationary pad having a pedestal and a support structure attached to a lower surface of the pedestal and extending downwardly therefrom and an attachment member connected to an end portion of the pedestal;

a single track having a first end and a second end, the first end being connected to and extending outwardly from the stationary pad at the attachment member, the single track having an "I" shape defined by a top surface, a track member extending downwardly from the top surface, and a bottom surface connected to the track member and positioned opposite the top surface;

a slidable vehicle slidably coupled to the track, the slidable vehicle comprising a first side vehicle member, a second side vehicle member, and a wheel rotatably coupled to both the first side vehicle member and the second side vehicle member, the wheel being positioned to interface with a top surface of the track, a stabilizing member rotatably coupled to at least one of the first side vehicle member and the second side vehicle member, a slidable pad fixedly connected to the slidable vehicle, the slidable pad comprising a first end and a second end that each comprise a raised section, and an elongate member attached to the stationary pad, the elongate member configured to extend generally upwards from the stationary pad, wherein the stationary pad comprises at least a receiving member configured to receive one end of the elongate member, each receiving member being associated with one elongate member;

a first bumper releasably attached to the single track adjacent the first end thereof;

a second bumper releasably attached to the single track adjacent the second end thereof;

each of the first and second bumpers including a top section, side sections and a bottom section configured so as to provide a gap between the top section and the bottom section, the gap being sized to receive the top surface of the single track when each of the first and second bumpers are slidably connected to the single track; and a hinge having a first plate and a second plate, wherein the first plate is rotatably coupled to the second plate, wherein the first plate is fixedly coupled to the stationary pad, and wherein the second plate is fixedly attached to the first end of the single track;

wherein the first and second side vehicle members are substantially parallel to each other and are set apart a distance greater than a width of the track; and wherein the stationary pad is adapted to support at least a portion of the anatomy of an exercising user performing exercises;

wherein each of the first and second bumpers are slidably connected to the single track to define an operational region of the single track whereby the slidable pad is moveable along the single track between the first and second bumpers.

14. An apparatus according to claim 13 wherein the track comprises a large track component and a small track component; wherein the small track component is configured to be at least partially inserted within the large track component.

15. An apparatus according to claim 13 further comprising a first track base and a resistive member having a first end and a second end; wherein the first end of the resistive member is attached to the first track.

* * * * *